US010292435B2

(12) United States Patent
Qiu

(10) Patent No.: US 10,292,435 B2
(45) **Date of Patent: *May 21, 2019**

(54) ELECTRONIC CIGARETTE

(71) Applicant: JOYETECH EUROPE HOLDING GMBH, Zug (CH)

(72) Inventor: Wei-Hua Qiu, ChangZhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/952,527

(22) Filed: Apr. 4, 2018

(65) Prior Publication Data

US 2018/0360114 A1 Dec. 20, 2018

Related U.S. Application Data

(63) Continuation-in-part of application No. 15/393,139, filed on Dec. 28, 2016, now Pat. No. 9,974,117.

(30) Foreign Application Priority Data

Jun. 8, 2016 (CN) ..... 2016 1 0405471

(51) Int. Cl.
*A24F 47/00* (2006.01)

(52) U.S. Cl.
CPC ..... *A24F 47/008* (2013.01)

(58) Field of Classification Search
CPC .. H05B 1/0244; H05B 2203/021; H05B 6/44; H05B 6/108; H05B 6/365; A24F 47/008; H02J 7/025; H02J 7/0072; H02J 50/10
USPC ..... 131/329, 194, 270, 273
See application file for complete search history.

(56) References Cited

U.S. PATENT DOCUMENTS

| | | | | |
|---|---|---|---|---|
| 5,269,327 | A * | 12/1993 | Counts | A24F 47/008 128/200.14 |
| 5,613,505 | A * | 3/1997 | Campbell | A24F 47/008 128/202.21 |
| 8,864,909 | B2 * | 10/2014 | Mishra | A24B 15/283 131/194 |
| 8,881,737 | B2 * | 11/2014 | Collett | H05B 3/265 131/273 |
| 9,974,117 | B2 * | 5/2018 | Qiu | H05B 1/0244 |
| 2016/0057811 | A1 * | 2/2016 | Alarcon | A24F 47/008 219/494 |
| 2016/0374400 | A1 * | 12/2016 | Monsees | A61M 15/06 131/329 |

FOREIGN PATENT DOCUMENTS

| | | | |
|---|---|---|---|
| CN | 2719043 | Y | 8/2005 |
| CN | 101116542 | A | 2/2008 |
| CN | 201199922 | Y | 3/2009 |
| CN | 100593982 | C | 3/2010 |
| CN | 203692552 | U | 7/2014 |

* cited by examiner

*Primary Examiner* — Edwin A. Leon
(74) *Attorney, Agent, or Firm* — ScienBiziP, P.C.

(57) ABSTRACT

An electronic cigarette includes a heating member; a sensor assembly includes an inductive chamber; a sensor arranged in the inductive chamber; and an airflow passage isolated from the sensor; wherein the heating member is arranged in the airflow passage.

18 Claims, 4 Drawing Sheets

ELECTRONIC CIGARETTE

CROSS-REFERENCE TO RELATED APPLICATIONS

The subject matter herein generally relates to electronic cigarettes. This application is a continuation application of U.S. patent application with Ser. No. 15/393139, filed on Dec. 28, 2016, which claims priority to CN Patent Application with Ser. No. 201610405471.X, filed on Jun. 8, 2016, the disclosure of which is incorporated herein by reference.

FIELD

The subject matter herein generally relates to electronic cigarettes.

BACKGROUND

A conventional electronic cigarette automatically controls the opening and closing of the electronic cigarette by detecting the suction action of a user, by a sensor arranged in an airflow passage adjacent to an air inlet. However, as the heating member is also located in the airflow passage, and the sensor is located between the heating member and the air inlet, the suction of the user is hindered by the heating member, and thus a greater suction force is needed to allow the airflow in the airflow passage cause air pressure for the detection by the sensor. On the other hand, since the heating member is in liquid communication with a smoke liquid storage member, the smoke liquid in the smoke liquid storage member may leak into the airflow passage through the heating member, and leaked smoke liquid may block the air inlet. Therefore, the air outside of the electronic cigarette may be blocked from entering into the airflow passage, thus affecting the detection by the sensor. Additionally, the leaked smoke liquid may enter into the sensor, which would cause the sensor to short-circuit. In addition, there may be residual smoke in the airflow passage that can cause the airflow passage to be humid. The sensor over a long period under such environment may affect its service life.

SUMMARY

The present disclosure provides an electronic cigarette having a sensor isolated from a heating member.

The electronic cigarette includes a heating member, a sensor assembly, and a cigarette holder having an air suction port in air communication with the air outside of the electronic cigarette. The sensor assembly includes an inductive chamber and a sensor arranged in the inductive chamber. The heating member is arranged outside of the inductive chamber. One end of the inductive chamber is an open end while the other end is a sealed end. The open end of the inductive chamber is in air communication with the air suction port.

The electronic cigarette further includes an airflow passage isolated from the inductive chamber and an air inlet in air communication with the air outside of the electronic cigarette. The airflow passage is in air communication with the air suction port and the air inlet. The heating member is arranged in the airflow passage.

The sensor assembly further includes a splitter plate and a shutoff piece. The splitter plate is arranged in the cigarette holder. The shutoff piece is located at one end of the cigarette holder opposite to the air suction port, and the shutoff piece is coupled to the splitter plate and an inner wall of one side of the cigarette holder. The inner wall of one side of the cigarette holder, one side of the splitter plate, and the shutoff piece together form the inductive chamber. The inner wall of the other side of the cigarette holder and the other side of the splitter plate together form a connection port. The air suction port is in air communication with the connection port, and one end of the airflow passage opposite to the air inlet is in air communication with the connection port.

The shutoff piece is a shutoff tube. One end of the shutoff tube is an open end, the other end of the shutoff tube is a sealed end. The shutoff tube is located at one end of the cigarette holder opposite to the air suction port, and the open end of the shutoff tube is coupled between the splitter plate and one side of the inner wall of the cigarette holder. The sealed end of the shutoff tube is the sealed end of the inductive chamber.

The shutoff piece is a shutoff plate. The shutoff plate is located at one end of the cigarette holder opposite to the air suction port, and the shutoff plate is coupled between the splitter plate and one side of the inner wall of the cigarette holder. The shutoff plate is the sealed end of the inductive chamber.

At least one of the splitter plate and the shutoff piece are integrally formed with the cigarette holder.

One end of the splitter plate adjacent to the air suction port extends into the air suction port, and divides the air suction port into a first air suction port and a second air suction port. The first air suction port is isolated from the second air suction port. The first air suction port is in air communication with the connection port, and the second air suction port is in air communication with the inductive chamber.

The sensor assembly further includes a film arranged in the inductive chamber and located above the sensor.

The airflow passage includes a smoke outlet part arranged along a lengthways axial direction of the electronic cigarette and an air inlet part arranged along a direction radiating out from the center line of the axial direction. The heating member is an open-ended and hollow structure. The heating member is in air communication with the air inlet part and the smoke outlet part. One end of the air inlet part opposite to the smoke outlet part is in air communication with the air inlet. One end of the smoke outlet part opposite to the air inlet part is in air communication with the air suction port.

The airflow passage includes an air inlet part arranged along the lengthways axial direction of the electronic cigarette and a smoke outlet part arranged along the same axial direction and fitted within the air inlet part. An upper end of the air inlet part is in air communication with the air inlet, and a lower end of the air inlet part is in air communication with the heating member. An upper end of the smoke outlet part is in air communication with the air suction port, and a lower end of the smoke outlet part is distanced from the heating member for the air inlet part in air communication with the smoke outlet part.

The electronic cigarette further includes a controller and a battery assembly. The heating member and the battery assembly are electrically connected with the controller. The sensor is connected with the controller through signals.

An electronic cigarette includes a heating member, a sensor, and an airflow passage. The heating member is arranged in the airflow passage. A passage wall of the airflow passage is at least partially made of a flexible material, to form an elastic portion. The sensor is arranged on the elastic portion and located outside of the airflow passage.

The electronic cigarette further includes a cigarette holder and a housing. One end of the cigarette holder defines an air suction port, the other end of the cigarette holder is coupled to the housing. The heating member, the sensor and the airflow passage are received in the housing. The housing defines an air inlet. The airflow passage is in air communication with the air suction port and the air inlet.

The airflow passage includes an air inlet part arranged along a radial direction of the electronic cigarette and a smoke outlet part arranged along an axial direction of the electronic cigarette.

The heating member is an open-ended and hollow structure. The heating member is in air communication with the air inlet part and the smoke outlet part. One end of the air inlet part opposite to the smoke outlet part is in air communication with the air inlet. One end of the smoke outlet part opposite to the air inlet part is in air communication with the air suction port.

The smoke outlet part is an open-ended and hollow tube. The hollow tube is made of the flexible material. The sensor is arranged outside of a wall of the hollow tube.

The sensor is a strain gauge type transducer or a capacitive type transducer.

The electronic cigarette further includes a storage member for storing smoke liquid. The heating member is in liquid communication with the storage member.

The electronic cigarette further includes a controller and a battery assembly. The heating member, the sensor and the battery assembly are electrically connected with the controller.

The battery assembly includes a battery module and a charging module. The controller and the charging module are electrically connected with the battery module.

When the electronic cigarette of the present disclosure is being used, one end of the inductive chamber is an open end and the other end is a sealed end. The open end of the inductive chamber is in air communication with the air suction port. The sensor is arranged in the inductive chamber. The heating member is arranged outside of the inductive chamber, so that the suction action of the user may directly act on the sensor without obstruction by the heating member. On the other hand, the inductive chamber is isolated from the airflow passage, thus the detection of the sensor is not affected by the leaked smoke liquid which blocks the air inlet. Since a humid environment in the inductive chamber is avoided, service life of this device is extended. The likelihood of short-circuited of the sensor caused by the leakage of the smoke liquid is also reduced.

According to another electronic cigarette of the present disclosure, the sensor is arranged outside of the airflow passage and senses the suction state of the user by sensing the deformation of the elastic portion of the airflow passage. The sensor is not arranged in the airflow passage, which can prevent the sensor from shortening a service life caused by an influence of a humid environment in the airflow passage, and also can prevent a circuit of the sensor from being short-circuited caused by the leakage of the smoke liquid.

The drawings should be combined with specific embodiments to fully describe the disclosure.

BRIEF DESCRIPTION OF THE DRAWINGS

Implementations of the present technology will now be described, by way of example only, with reference to the attached figures.

Referring to FIGS. 1-4, 100 and 200 represent an electronic cigarette in a first embodiment and in a second embodiment respectively. As between the two embodiments, 10 and 10*a* represent a cigarette holder, 11 and 11*a* represent an air suction port, 12 represents a connection port, 111 represents a first air suction port, 112 represents a second air suction port, 20 and 20*a* represent a heating member, and 30 and 30*a* represent a controller. 40 represents a sensor assembly, 41 represents an inductive chamber, 411 represents a first open end, 412 represents a first sealed end, 42 and 42*a* represent a sensor, 43 represents a splitter plate, 44 represents a shutoff piece, 441 represents a second open end, 442 represents a second sealed end, 443 represents an inner chamber, 45 represents a film, 50 and 50*a* represent a battery assembly, 51 and 51*a* represent a battery module, 52 and 52*a* represent a charging module, and 60 and 60*a* represent an airflow passage. 61 and 61*a* represent an air inlet part, 62 and 62*a* represent a smoke outlet part, 70 and 70*a* represent a storage member, 71 and 71*a* represent a liquid inlet hole, 80 and 80*a* represent a housing, and 81 and 81*a* represent an air inlet.

DETAILED DESCRIPTION

Figure 1:
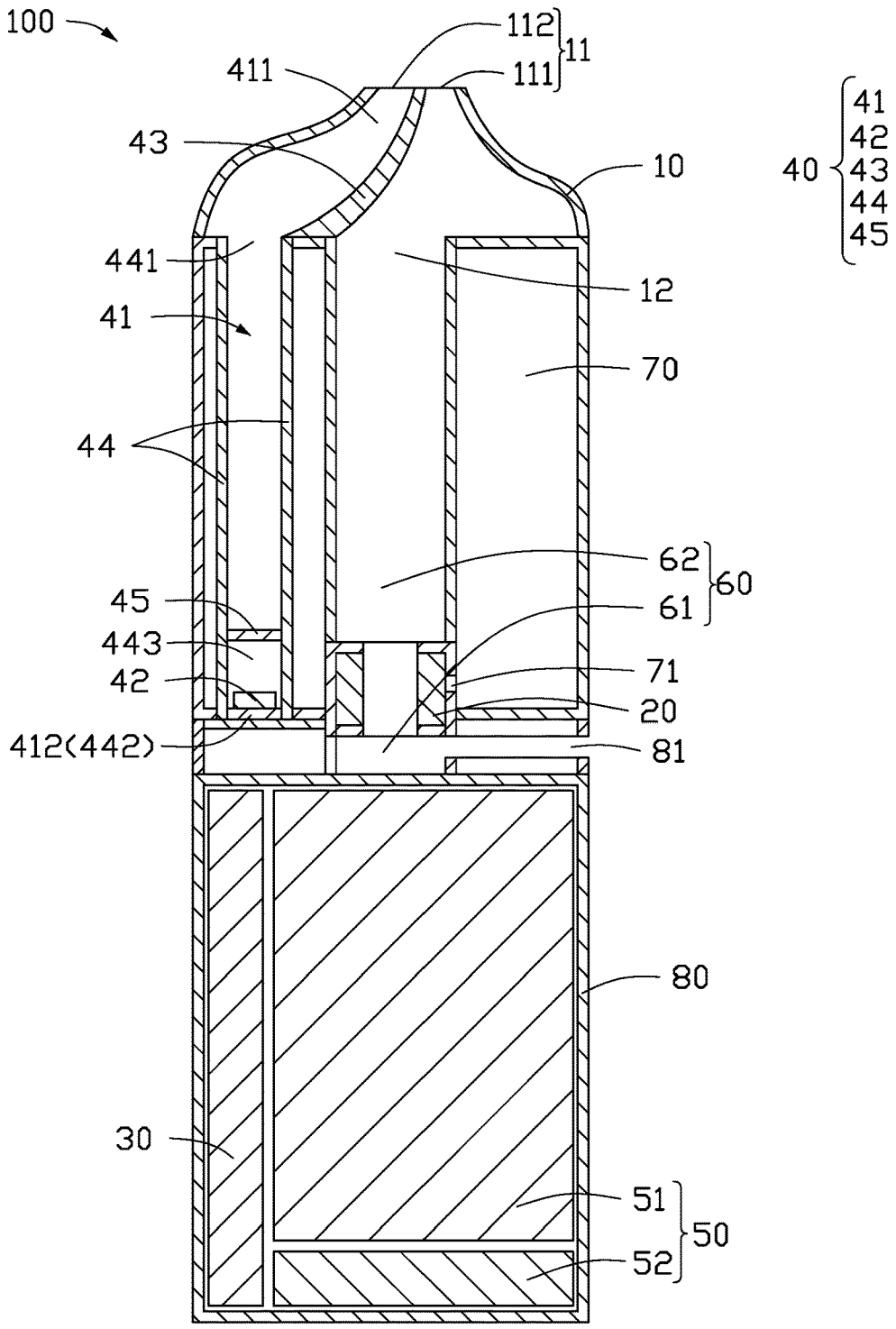
FIG. 1 is a cross-sectional view of an electronic cigarette in one mode according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection may be such that the objects are permanently connected or releasably connected. The term "outside" refers to a region that is beyond the outermost confines of a physical object. The term "substantially" is defined to be essentially conforming to the particular dimension, shape, or other feature that the term modifies, such that the component need have that exact feature. The term "comprising," when utilized, means "including, but not necessarily limited to"; it specifically indicates open-ended inclusion or membership in the so-described combination, group, series and the like.

The terms "first", "second" and other terms in the present disclosure are only used as textual symbols as the circumstances may require, but such a practice of ordination is not limited to using only these terms. It should be further noted that these terms can be used interchangeably.

Referring to FIG. 1, in a first embodiment, an electronic cigarette 100 includes a cigarette holder 10, a heating member 20, a controller 30, a sensor assembly 40, and a battery assembly 50. The cigarette holder 10 has an air suction port 11 in air communication with the air outside of the electronic cigarette 100. The sensor assembly 40 includes an inductive chamber 41 and a sensor 42 arranged in the inductive chamber 41. The heating member 20 and the battery assembly 50 are electrically connected with the controller 30, and the sensor 42 is connected with the controller 30 through signals. The heating member 20 is arranged outside of the inductive chamber 41. The inductive chamber 41 has two ends, one end of the inductive chamber 41 is a first open end 411, and the other end of the inductive chamber 41 is a first sealed end 412. The first open end 411 of the inductive chamber 41 is in air communication with the air suction port 11.

When a user inhales through the air suction port 11, at least part of air within the inductive chamber 41 is sucked out. Air pressure in the inductive chamber 41 decreases, thus the sensor 42 may detect the change of the pressure, generate a trigger signal, and send the trigger signal to the controller 30. The controller 30 receives the trigger signal, and controls the battery assembly 50 to supply electrical power to the heating member 20.

When the user stops inhaling through the air suction port 11, the inductive chamber 41 is in air communication with the air outside of the electronic cigarette 100 by the air suction port 11, to restore the air pressure in the inductive chamber 41. Thus, the sensor 42 may sense the restored air pressure, and generate a shutdown signal and transmit the shutdown signal to the controller 30. The controller 30 receives the shutdown signal, and controls the battery assembly 50 to stop supplying electrical power to the heating member 20.

The sensor assembly 40 includes a splitter plate 43 and a shutoff piece 44. The splitter plate 43 is arranged in the cigarette holder 10 and divides an inner space of the cigarette holder into a first inner space and a second inner space. The shutoff piece 44 is located at one end of the cigarette holder 10 opposite to the air suction port 11, and the shutoff piece 44 is coupled to the splitter plate 43 and an inner wall of one side of the cigarette holder 10. Thus, the inner wall of one side of the cigarette holder 10, one side of the splitter plate 43, and the shutoff piece 44 together form the inductive chamber 41, i.e, the first inner space and the shutoff piece 44 together form the inductive chamber 41. An inner wall of the other side of the cigarette holder 10 and the other side of the splitter plate 43 together form a connection port 12, i.e., the second inner space forms the connection port 12. The connection port 12 is in air communication with the air suction port 11.

In one mode, the shutoff piece 44 is a shutoff tube. The shutoff tube has two ends. On end of the shutoff tube is a second open end 441, the other end of the shutoff tube is a sealed end 442. The second open end 441 of the shutoff tube is coupled to the splitter plate 43 and one side of the inner wall of the cigarette holder 10, respectively, and the second open end 441 of the shutoff tube is located at one end of the cigarette holder 10 opposite to the air suction port 11. The second sealed end 442 of the shutoff tube is the first sealed end 412 of the inductive chamber 41. The shutoff tube has an inner chamber 443. The inner chamber 443 of the shutoff tube is also a part of the inductive chamber 41. The sensor 42 may be arranged in the inner chamber 443 of the shutoff tube, so a location of the sensor 42 may be changed according to a suitable size and/or shape of the shutoff tube. In the embodiment, the second sealed end 442 of the shutoff tube is arranged adjacent to the controller 30. The sensor 42 is arranged in the inner chamber 443 of the shutoff tube, and located at the second sealed end 442 of the shutoff tube, thus facilitating the electrical connection of the sensor 42 with the controller 30.

Figure 2:
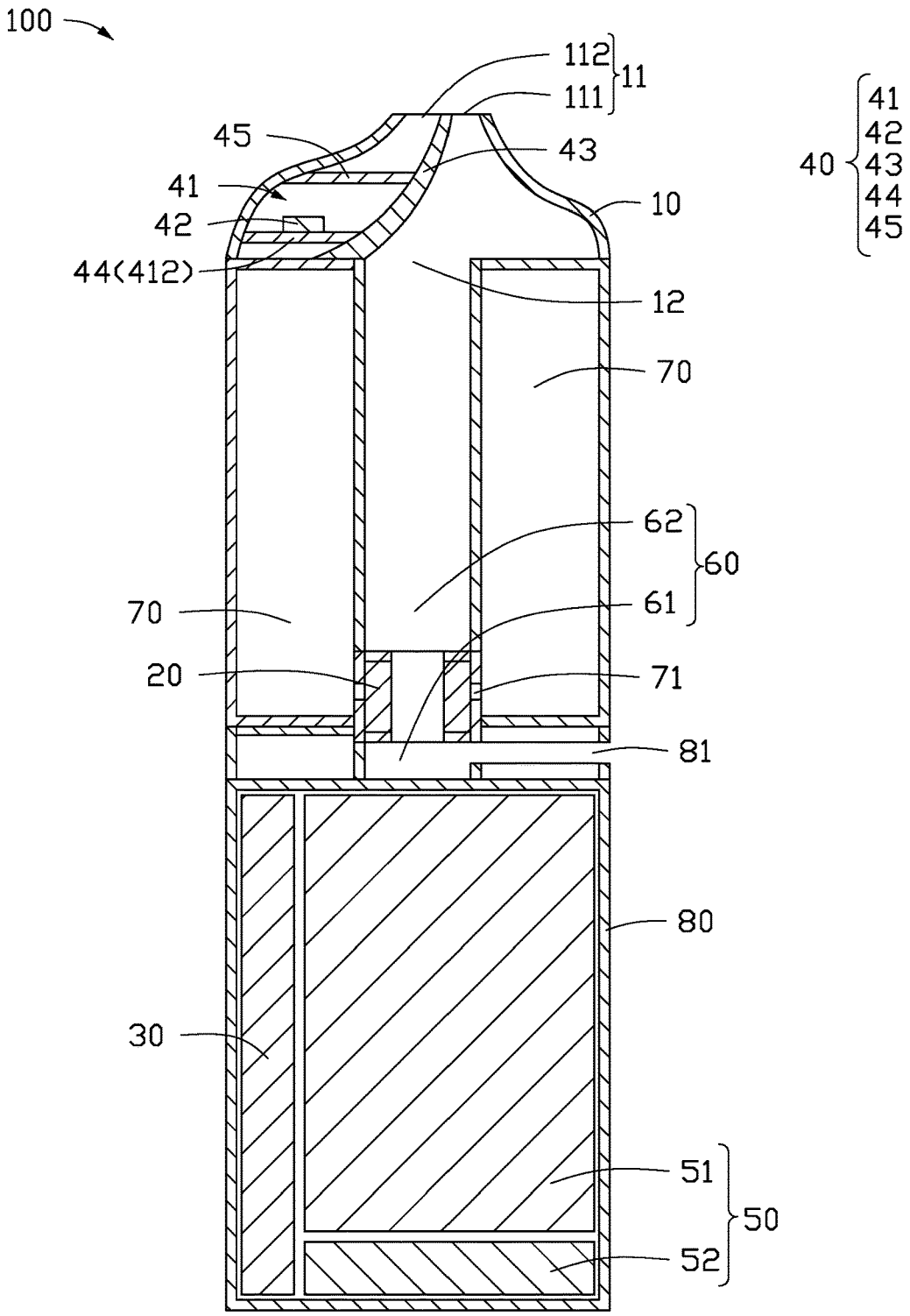
FIG. 2 is a cross-sectional view of the electronic cigarette according to the first embodiment in another mode.

Referring to FIG. 2, in another mode, the shutoff piece 44 is a shutoff plate. The shutoff plate is coupled to the splitter plate 43 and one side of the inner wall of the cigarette holder 10, respectively. The shutoff plate is located at one end of the cigarette holder 10 opposite to the air suction port 11. The shutoff plate is the first sealed end 412 of the inductive chamber 41. By using the shutoff plate, a size of the inductive chamber 41 can be reduced, thus space within the electronic cigarette 100 can be saved. The saved space can be used to store the smoke liquid. The sensor 42 is adjacent to the air suction port 11 by using the shutoff plate, thus facilitating the accuracy of the sensor 42 when detecting inhalations of the user.

In other embodiments, at least one of the splitter plate 43 and the shutoff piece 44 may be integrally formed with the cigarette holder 10.

Referring again to FIG. 1, one end of the splitter plate 43 adjacent to the air suction port 11 extends into the air suction port 11, to divide the air suction port 11 into a first air suction port 111 and a second air suction port 112. The first air suction port 111 and the second air suction port 112 are isolated from each other. The first air suction port 111 is in air communication with the connection port 12, and the second air suction port 112 is in air communication with the inductive chamber 41. The smoke created in the electronic cigarette 100 flows from the connection port 12 to the first air suction port 111, and the air in the inductive chamber 41 is sucked out by the second air suction port 112, which may prevent the smoke entering into the inductive chamber 41 through a connection (not shown) among the connection port 12, the inductive chamber 41, and the air suction port 11, render the air pressure in the inductive chamber 41 more reliable and prevent detection interference to the sensor 42.

Furthermore, the sensor assembly 40 further includes a film 45 arranged in the inductive chamber 41 and located above the sensor 41. The film 45 may be impermeable and deformable. The arrangement of the film 45 can prevent contamination from the air suction port 11 or the second air suction port 112 from entering into the inductive chamber 41 and polluting the sensor 42, thereby affecting the sensitivity of the sensor 42. When the user inhales through the air suction port 11 or the second air suction port 112, the air within in the inductive chamber 41 and located above the film 45 is at least partially sucked out from the air suction port 11 or the second air suction port 112. Thus, the film 45 is raised upward toward the air suction port 11 or the second air suction port 112, and a space formed between the film 45 and one end of the shutoff piece 44 adjacent to the sensor 42 in the inductive chamber 41 increases, thus reducing air pressure in the space below the film 45 within the inductive chamber 41. The sensor 42 may sense the pressure change, generate the trigger signal, and send the trigger signal to the controller 30. The controller 30 receives the trigger signal, and controls the battery assembly 50 to supply an electrical power to the heating member 20. When the user stops inhaling from the air suction port 11 or the second air suction port 112, the space above the film 45 within the inductive chamber 41 is in air communication with the air outside through the air suction port 11 or the second air suction port 112, and allows the air pressure to be restored. Thus, a deformation of the film 45 is restored, and the pressure in the space below the film 45 within the inductive chamber 41 is restored. The sensor 42 may sense the restored air pressure, and generate the shutdown signal to the controller 30. The controller 30 receives the shutdown signal, and controls the battery assembly 50 to stop supplying the electrical power to the heating member 20.

The battery assembly 50 includes a battery module 51 and a charging module 52. The controller 30 and the charging module 52 are electrically connected with the battery module 51. The battery module 51 is configured to supply the electric power to the heating member 20 under the control of the controller 30. The charging module 52 is configured to couple to an external power source, to allow the external power source to charge the battery module 51.

The electronic cigarette 100 further includes an airflow passage 60, a storage member 70, and a housing 80. The airflow passage 60 is isolated from the inductive chamber 41. The storage member 70 is configured to store the smoke liquid. One end of the cigarette holder 10 opposite to the air suction port 11 is coupled to the housing 80. The heating member 20, the controller 30, the battery assembly 50, the airflow passage 60, and the storage member 70 are received in the housing 80. In one embodiment, the sensor assembly 40 is received in the cigarette holder 10. In another embodiment, one part of the sensor assembly 40 is received in the cigarette holder 10, the other part of the sensor assembly 40 is received in the housing 80. The housing 80 defines an air inlet 81. The airflow passage 60 is in air communication with the connection port 12 and the air inlet 81. The heating member 20 is arranged in the airflow passage 60 and is in liquid communication with the storage member 70. A wall of the storage member 70 defines a liquid inlet hole 71 aligned with the heating member 20. The smoke liquid stored in the storage member 70 flows to the heating member 20 through the liquid inlet hole 71. When the battery module 51 supplies the electric power to the heating member 20, the heating member 20 heats the smoke liquid to form smoke. Air flows into the airflow passage 60 through the air inlet 81, flows through the heating member 20 and mixes with the smoke, then flows to the connection port 12, and finally flows out from the air suction port 11 or the first air suction port 111 when inhaled.

In the present embodiment, the airflow passage 60 is substantially L-shaped. The airflow passage 60 includes an air inlet part 61 and a smoke outlet part 62. The smoke outlet part 62 is arranged along an axial and lengthways direction of the electronic cigarette 100 and the air inlet part 61 is arranged along a direction extending radially from the center line of the axial direction of the electronic cigarette 100. The heating member 20 is a hollow and open-ended structure. The hollow structure allows communication between the air inlet part 61 and the smoke outlet part 62. One end of the air inlet part 61 opposite to the smoke outlet part 62 is in air communication with the air inlet 81. One end of the smoke outlet part 62 opposite to the air inlet part 61 is in air communication with the connection port 12.

Figure 3:
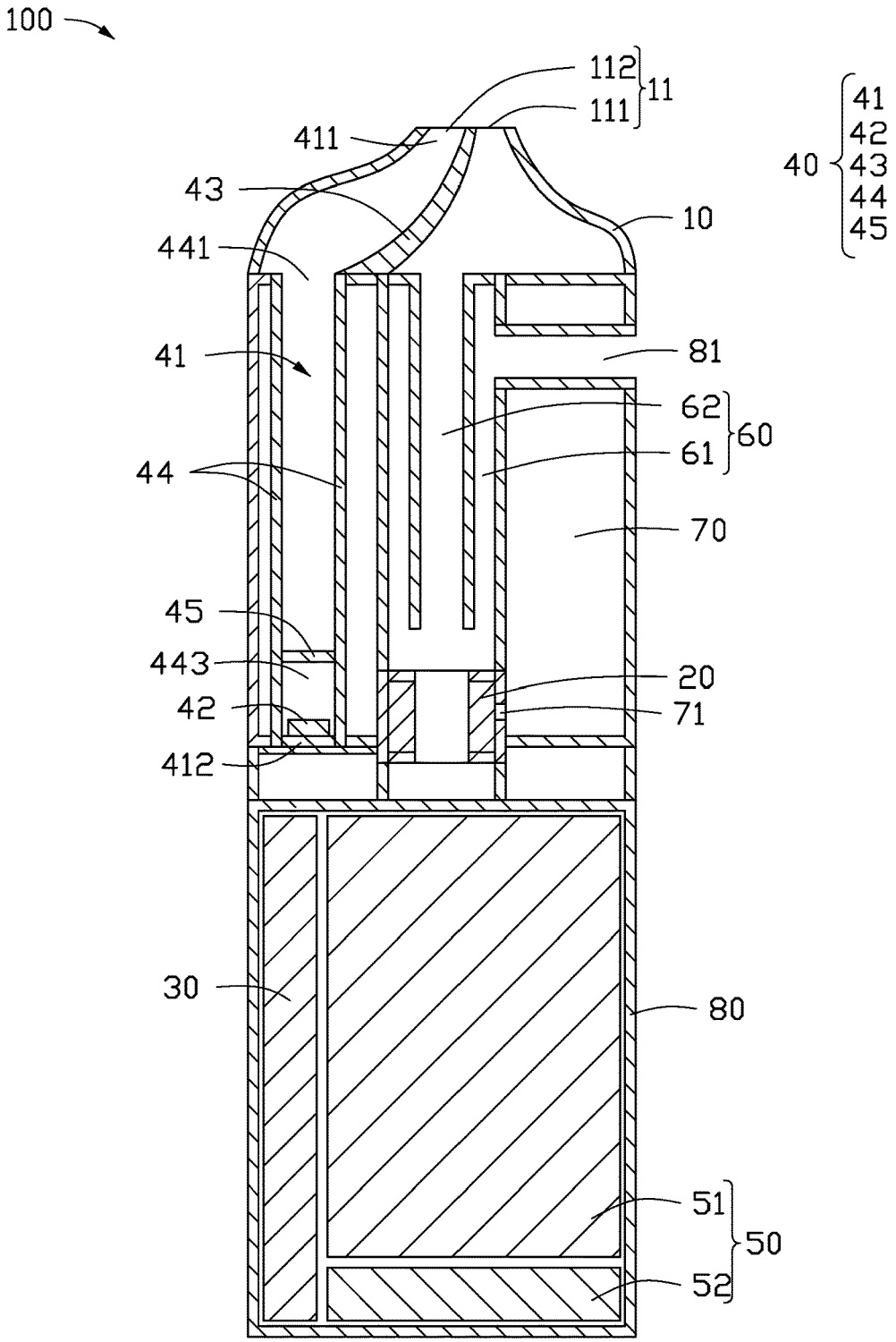
FIG. 3 is a cross-sectional view of yet another mode of the electronic cigarette according to the first embodiment.

Referring to FIG. 3, in another mode, the airflow passage 60 includes an air inlet part 61 and a smoke outlet part 62. The air inlet part 61 is arranged along the axial direction of the electronic cigarette 100. The smoke outlet part 62 is arranged along the axial direction of the electronic cigarette 100 and fitted within the air inlet part 61. An upper end of the air inlet part 61 is in air communication with the air inlet 81, and a lower end of the air inlet part 61 is connected to the heating member 20. An upper end of the smoke outlet part 62 is in air communication with the connection port 12, and a lower end of the smoke outlet part 62 is distanced from the heating member 20 for the air inlet part 61 in air communication with the smoke outlet part 62.

In the present mode, the inductive chamber 41 has two ends. One end of the inductive chamber 41 is a first open end 411, the other end of the inductive chamber 41 is a first sealed end 412. The open end of the inductive chamber 41 is in air communication with the air suction port 11. The sensor 42 is arranged in the inductive chamber 41, and the heating member 20 is arranged outside of the inductive chamber 41, to allow the suction action of the user directly act on the sensor 42 without obstruction by the heating member 20. On the other hand, the inductive chamber 41 is isolated from the airflow passage 60, thus the detection of the sensor 42 is not affected by the leaked smoke liquid which blocks the air inlet 81. Since a humid environment in the inductive chamber 41 is avoided, service life of this device is extended. The likelihood of short-circuited of the sensor 42 caused by the leakage of the smoke liquid is also reduced.

Figure 4:
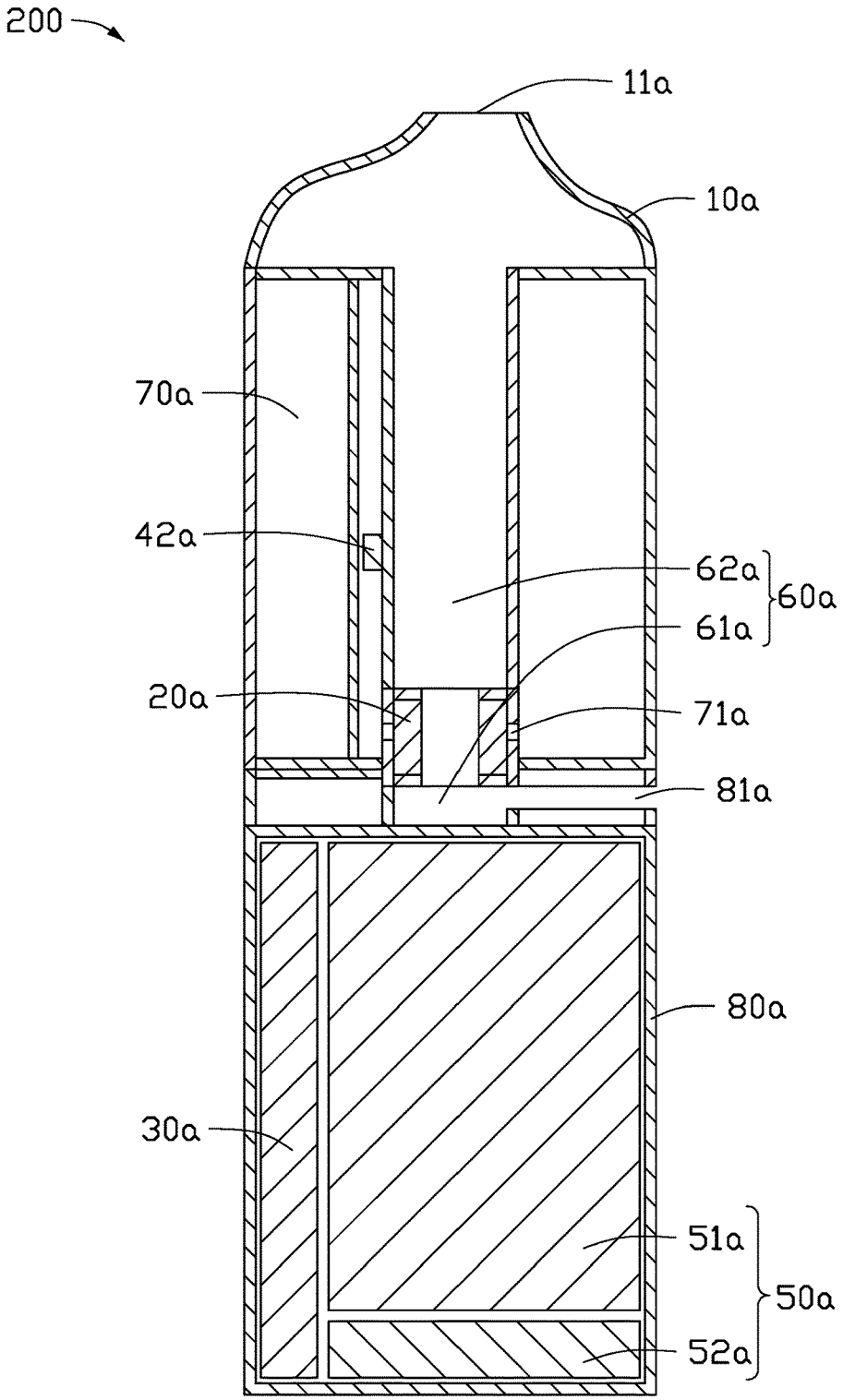
FIG. 4 is a cross-sectional view of an electronic cigarette according to a second embodiment.

Referring to FIG. 4, in a second embodiment, an electronic cigarette 200 includes a cigarette holder 10*a*, a heating member 20*a*, a controller 30*a*, a sensor 42*a*, a battery assembly 50*a*, an airflow passage 60*a*, a storage member 70*a* storing a smoke liquid, and a housing 80*a*. The cigarette holder 10*a* has two ends. One end of the cigarette holder 10*a* defines an air suction port 11*a*, the other end of the cigarette holder 10*a* is coupled to the housing 80*a*. The heating member 20*a*, the controller 30*a*, the sensor 42*a*, the battery assembly 50*a*, the airflow passage 60*a*, and the storage member 70*a* are received in the housing 80*a*. The heating member 20*a*, the sensor 42*a*, and the battery assembly 50*a* are electrically connected with the controller 30*a*. The housing 80*a* defines an air inlet 81*a*. The airflow passage 60*a* is in air communication with the air suction port 11*a* and the air inlet 81*a*. The heating member 20*a* is arranged in the airflow passage 60*a*, and is in liquid communication with the storage member 70*a*. The airflow passage 60*a* has a passage wall. The passage wall of the airflow passage 60*a* is at least partially made of a flexible material, to form an elastic portion. The sensor 42*a* is arranged on the elastic portion and located outside of the airflow passage 60*a*.

When the user inhales through the air suction port 11*a*, an air pressure within the airflow passage 60*a* decreases, and the elastic portion deforms. Thus, the sensor 42*a* may sense the deformation, and generate a trigger signal and send the trigger signal to the controller 30*a*. The controller 30*a* receives the trigger signal, and controls the battery assembly 50*a* to supply an electrical power to the heating member 20*a*. A wall of the storage member 70*a* defines a liquid inlet hole 71*a* aligned with the heating member 20*a*. The smoke liquid stored in the storage member 70*a* flows to the heating member 20*a* through the liquid inlet hole 71*a*. The heating member 20*a* heats the smoke liquid to create smoke. Air from outside flows into the airflow passage 60*a* through the air inlet 81*a*, then mixes with the smoke, and finally flows out from the air suction port 11*a*.

When the user stops inhaling through the air suction port 11*a*, the airflow passage 60*a* is in air communication with the air outside of the electronic cigarette 200 through the air suction port 11*a*. The air pressure in the airflow passage 60*a* is restored and the deformation of the elastic portion is discontinued. Thus, the sensor 42*a* can sense the restoration of the elastic portion, and generates a shutdown signal to the controller 30*a*. The controller 30*a* receives the shutdown signal, and controls the battery assembly 50*a* to stop supplying the electrical power to the heating member 20*a*.

The sensor 42*a* may be a strain gauge type transducer or a capacitive type transducer.

In one embodiment, the airflow passage 60*a* is substantially L-shaped. The airflow passage 60*a* includes an air inlet part 61*a* and a smoke outlet part 62*a*. The air inlet part 61*a* is arranged radially from the lengthways axis of the electronic cigarette 200, and the smoke outlet part 62*a* is arranged along the lengthways axis. The heating member 20*a* is a hollow and open-ended structure. The hollow structure communicates between the air inlet part 61*a* and the smoke outlet part 62*a*. One end of the air inlet part 61*a* opposite to the smoke outlet part 62*a* is in air communication with the air inlet 81*a*. One end of the smoke outlet part 62*a* opposite to the air inlet part 61*a* is in air communication with the air suction port 11*a*. The smoke outlet part 62*a* is a hollow and open-ended tube. The smoke outlet part 62*a* is made of a flexible material. The sensor 42*a* is arranged outside of the wall of the hollow tube.

The battery assembly 50*a* includes a battery module 51*a* and a charging module 52*a*. The controller 30*a* and the charging module 52*a* are electrically connected the battery module 51*a*. The battery module 51*a* is configured to supply the electric power to the heating member 20*a* under the control of the controller 30*a*. The charging module 52*a* is configured to couple to an external power source, to allow the external power source to charge the battery module 51*a*.

In this embodiment, the sensor 42*a* of the electronic cigarette 200 is arranged outside of the airflow passage 60*a*, to sense inhalations of the user by sensing the deformation of the elastic portion of the airflow passage 60*a*. By not arranging the sensor 42*a* in the airflow passage 60*a*, the service life of the sensor 42*a* is prolonged due to a less humid environment, and also the likelihood of the sensor 42*a* being short-circuited caused by the leakage of the smoke liquid is reduced.

The embodiments shown and described above are only examples. Many details are often found in the art such as the other features of an electronic cigarette. Therefore, many such details are neither shown nor described. Even though numerous characteristics and advantages of the embodiments have been set forth in the foregoing description, together with details of the structure and function of the embodiments, the present disclosure is illustrative only, and changes may be made in details, including in the matters of shape, size, and arrangement of parts within the principles of the embodiments to the full extent indicated by the broad general meaning of the terms in which the appended claims are expressed.

What is claimed is:

1. An electronic cigarette comprising:

a heating member;

a sensor assembly, comprising:

an inductive chamber;

a sensor arranged in the inductive chamber; and an airflow passage isolated from the sensor;

wherein the heating member is arranged in the airflow passage.

2. The electronic cigarette of claim 1, wherein the heating member is located outside of the inductive chamber, the inductive chamber has two ends, one end of the inductive chamber is a first open end, the other end of the inductive chamber opposite to the first open end is a first sealed end.

3. The electronic cigarette of claim 1, wherein the electronic cigarette further comprises an air inlet in air communication with air outside of the electronic cigarette, wherein the airflow passage is in air communication with the air inlet.

4. The electronic cigarette of claim 3, wherein the electronic cigarette further comprises a cigarette holder having an air suction port in air communication with the air outside of the electronic cigarette.

5. The electronic cigarette of claim 4, wherein the sensor assembly further comprises a splitter plate and a shutoff piece, the splitter plate is arranged in the cigarette holder and divides an inner space of the cigarette holder into a first inner space and a second inner space; the shutoff piece is located at one end of the cigarette holder opposite to the air suction port; the first inner space and the shutoff piece together form the inductive chamber; the second inner space forms a connection port, the air suction port is in air communication with the connection port.

6. The electronic cigarette of claim 5, wherein one end of the airflow passage opposite to the air inlet is in air communication with the connection port.

7. The electronic cigarette of claim 5, wherein at least one of the splitter plate and the shutoff piece are integrally formed with the cigarette holder.

8. The electronic cigarette of claim 5, wherein one end of the splitter plate adjacent to the air suction port extends into the air suction port, and divides the air suction port into a first air suction port and a second air suction port, the first air suction port is isolated from the second air suction port, the first air suction port is in air communication with the connection port, the second air suction port is in air communication with the inductive chamber.

9. The electronic cigarette of claim 4, wherein the airflow passage further comprises a smoke outlet part and an air inlet part; the heating member is an open-ended and hollow structure; the heating member is in air communication with the air inlet part and the smoke outlet part; one end of the air inlet part opposite to the smoke outlet part is in air communication with the air inlet, one end of the smoke outlet part opposite to the air inlet part is in air communication with the air suction port.

10. The electronic cigarette of claim 4, wherein the electronic cigarette further comprises a controller and a battery assembly, wherein the heating member and the battery assembly are electrically connected to the controller, the sensor is connected to the controller through signals.

11. The electronic cigarette of claim 10, wherein the electronic cigarette further comprises a storage member configured to store the smoke liquid.

12. The electronic cigarette of claim 11, wherein the electronic cigarette further comprises a housing, wherein the heating member, the controller, the battery assembly, the airflow passage, and the storage member are received in the housing.

13. The electronic cigarette of claim 12, wherein one end of the cigarette holder opposite to the air suction port is coupled to the housing.

14. The electronic cigarette of claim 4, wherein the sensor assembly is received in the cigarette holder.

15. The electronic cigarette of claim 12, wherein one part of the sensor assembly is received in the cigarette holder, the other part of the sensor assembly is received in the housing.

16. The electronic cigarette of claim 12, wherein the air inlet is located on the housing.

17. The electronic cigarette of claim 11, wherein the heating member is in liquid communication with the storage member.

18. The electronic cigarette of claim 1, wherein the sensor assembly further comprises a film arranged in the inductive chamber and located above the sensor.

* * * * *